US005868247A

United States Patent [19]

Schrader

[11] Patent Number: 5,868,247

[45] Date of Patent: Feb. 9, 1999

[54] CONVERTIBLE HARDSHELL GOLFBAG

[76] Inventor: Gunter Schrader, 13 Broadmoor Rd., Rotunda West, Fla. 33947

[21] Appl. No.: 790,724

[22] Filed: Jan. 31, 1997

[51] Int. Cl.[6] ..... A63B 55/00

[52] U.S. Cl. ..... 206/315.4; 206/315.5; 206/315.6; 206/315.7; 280/47.18; 280/47.24; 280/DIG. 6

[58] Field of Search ..... 206/315.3, 315.4, 206/315.5, 315.6, 315.7, 315.8; 280/47.18, 47.24, DIG. 6

[56] References Cited

U.S. PATENT DOCUMENTS

| | | | |
|---|---|---|---|
| 4,383,563 | 5/1983 | Kirchhoff | 206/315.5 X |
| 4,442,937 | 4/1984 | Delauder | 206/315.4 |
| 4,522,299 | 6/1985 | Clark et al. | 206/315.3 |
| 4,905,827 | 3/1990 | Kim | 206/315.3 |
| 5,074,576 | 12/1991 | Finlay | 206/315.6 X |
| 5,112,068 | 5/1992 | Liao et al. | 206/315.3 X |
| 5,168,992 | 12/1992 | Bowdy | 206/315.6 |

*Primary Examiner*—Stephen Cronin
*Attorney, Agent, or Firm*—Frank A. Lukasik

[57] ABSTRACT

The invention is a hard-shell convertible golf bag generally made of plastic and comprises a built-in extend and retract feature. The general structure is made of three major parts, a hard-shell front, a hard-shell back and a hard-shell head-cover. The wheels may be retracted for shipping on an airliner, or carrying the bag on a golf cart, or extended to pull when walking on a golf course. A second handle is provided for pulling the folded golf bag on a smooth surface.

2 Claims, 11 Drawing Sheets

CONVERTIBLE HARDSHELL GOLFBAG

BACKGROUND OF THE INVENTION

1. Field of the Invention

This invention relates generally to golf bags and more particularly to a golf bag that is convertible to a golf cart and shipping case.

2. With the current state of the art golf equipment, golfers first purchase a golf bag and clubs, then a folding golf cart for those occasions when walking is desired, then a secure golf bag cover for commercial travel. In addition, a golfer must carry a pair of spiked shoes, either in an additional handbag when traveling, or in the car trunk when driving to a golf course for a match. In addition, the golfer must carry towels to clean the golf clubs during play or to wipe persperation during play. Additional equipment includes spare golf balls, tees, insect repellent, etc. Current golf bags have one or two pockets affixed to the bag in an effort to provide sufficient storage space. There is, however, insufficient space to carry larger objects such as golf shoes.

In addition to the golf bag, many golfers also own golf carts, which can fold into relatively compact arrangement for carrying in the trunk of a car or storage in a cart shed of a country club.

Another requirement is for a secure carrying bag for carrying a golf bag on a vacation or business trip. The bag must be stiff enough to withstand the rigors of moving along a conveyor belt in an air terminal but still be light enough to carry to the ckeck-in counter at the air terminal. The combined weight of a golf bag and the carrying bag makes the transportation of golf clubs s greater burden than a golf bag by itself, however, a golf bag will not retain golf clubs securely during travel.

SUMMARY OF THE INVENTION

The invention is a hard-shell convertible golf bag which can be manufactured from a stable, thermo-plastic such as PVC, ABS, or Polypropylene, etc. The invention has a built-in extend and retract pull-cart feature. The convertible golf bag was created with the ease of travel in mind and also to be used on a golf course while playing. The built-in wheels are retractable for traveling on a smooth surface like airports, roads, driveways, etc. The convertible golf bag is equally ready to play on a rough surface such as a fairway or rough, with the wheels extended.

The open coverhead of the invention, with a handle for ease of pulling also provides a very good stand for balance. The golf bag may hold 14 golf clubs, an umbrella, a ball tube that stores up to 17 balls, a scoreboard holder, shoes, etc. The ball tube has a feature that releases balls one at a time from the bottom of the bag.

The wheels and frame are easily extended or retracted by pushing a button on a click-lock. The front of the bag, which opens up forward, has a great deal of storage area for all of the items a golfer needs. The storage compartments are similar to a small gym locker with compartments that can be used for various needs of each golfer. The entire bag can be closed and locked-up completely with one key. When the cover head is in the open and locked position, a lever will mount it on the rear to pull the golf bag over the golf course. The cover head can be easily removed or installed when transporting the convertible golf bag on a golf cart.

If it starts to rain while a golfer is playing golf, another cover is not needed, a lever in the cover head need only be released and the cover head closed to travel position since the bag is waterproof.

Both sides of the bag have hooks for towels, brush, and/or a membership card.

DESCRIPTION OF THE PREFERRED EMBODIMENT

Figure 1:
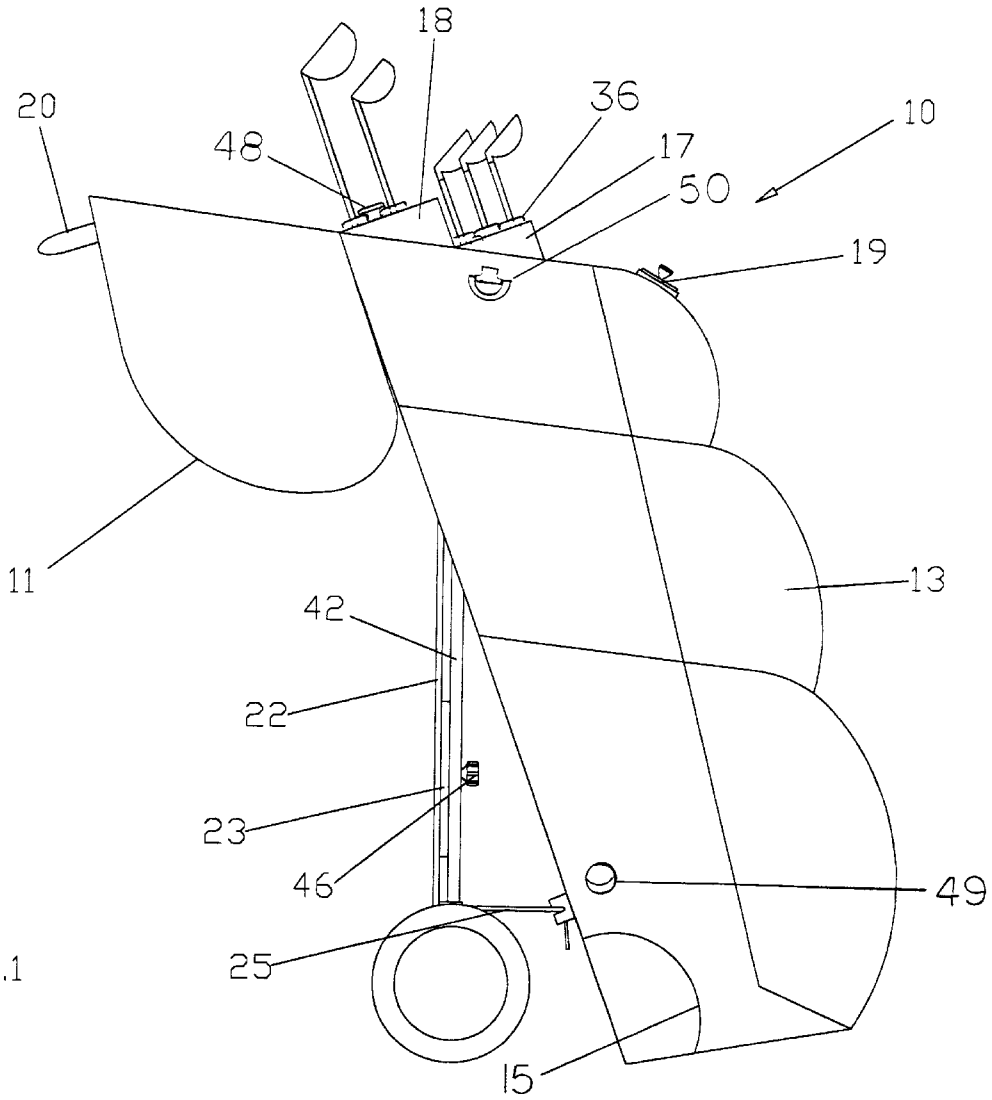
FIG. 1 is a side view of the convertible golf bag in a playing position.

Referring to FIG. 1, there is shown the convertible hardshell golf bag of the invention as indicated generally by the numeral 10. The hardshell golf bag may be manufactured from a stable, thermo-plastic or other plastic material and may be manufactured by any well known process. The golf bag 19 is comprised of three principle parts, the coverhead 11, the hardshell back 12, and the hardshell front 13. Back plate 22 is rotatably connected to hardshell back 12 with hinge 24.

Figure 2:
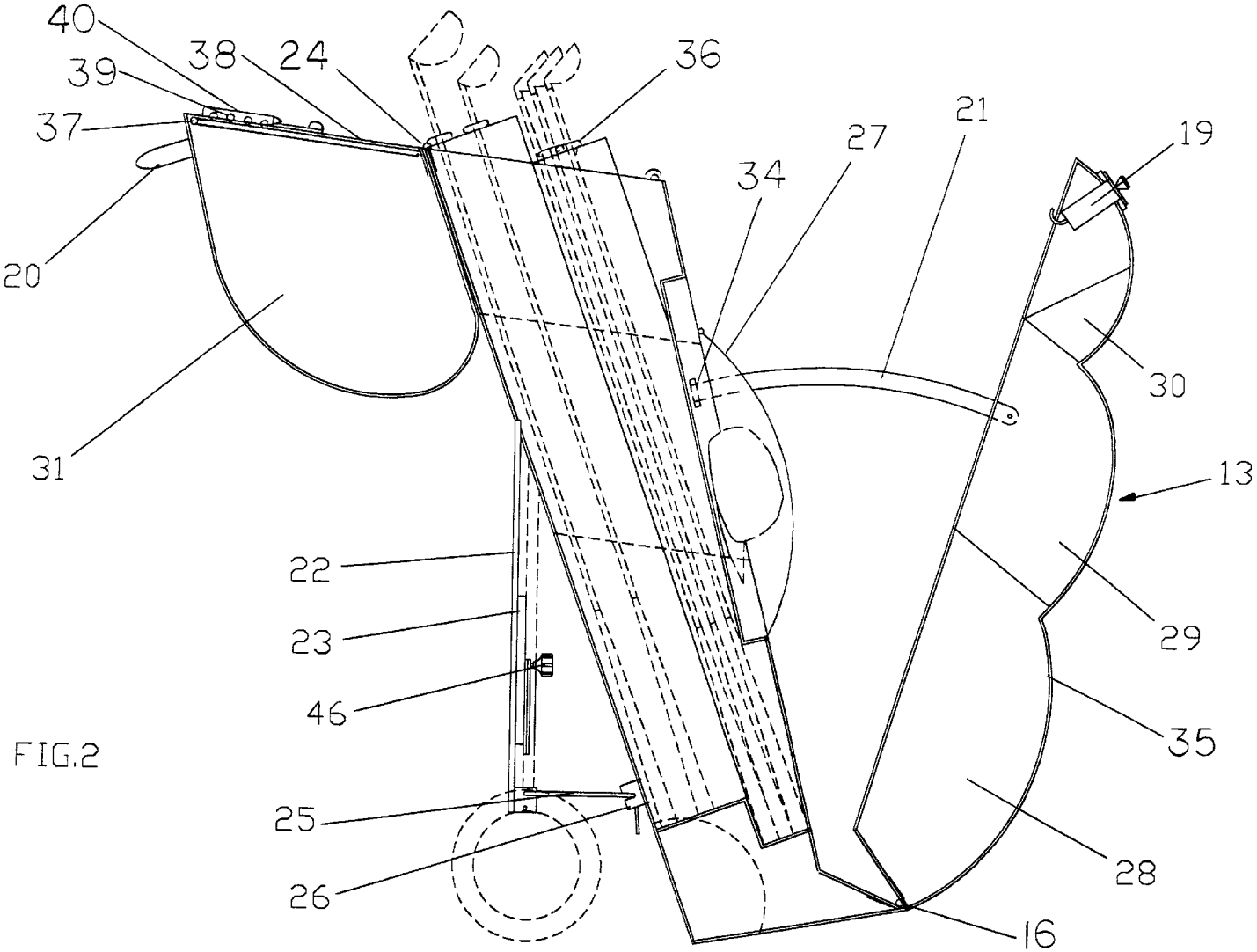
FIG. 2 is side sectional view of the convertible golf bag in a playing position.
Figure 3:
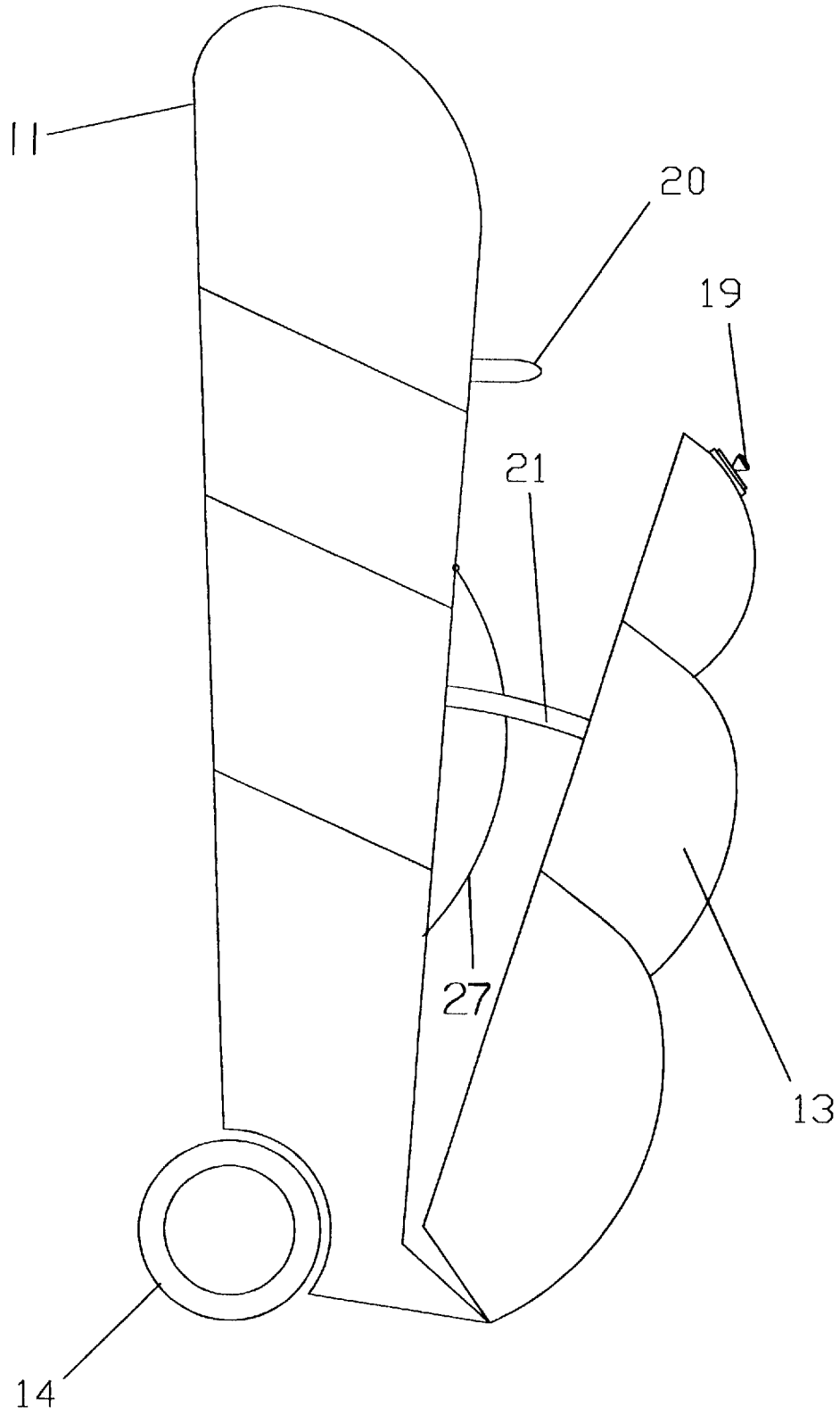
FIG. 3 is a side view of the convertible golf bag with the storage compartment in an open position.
Figure 4:
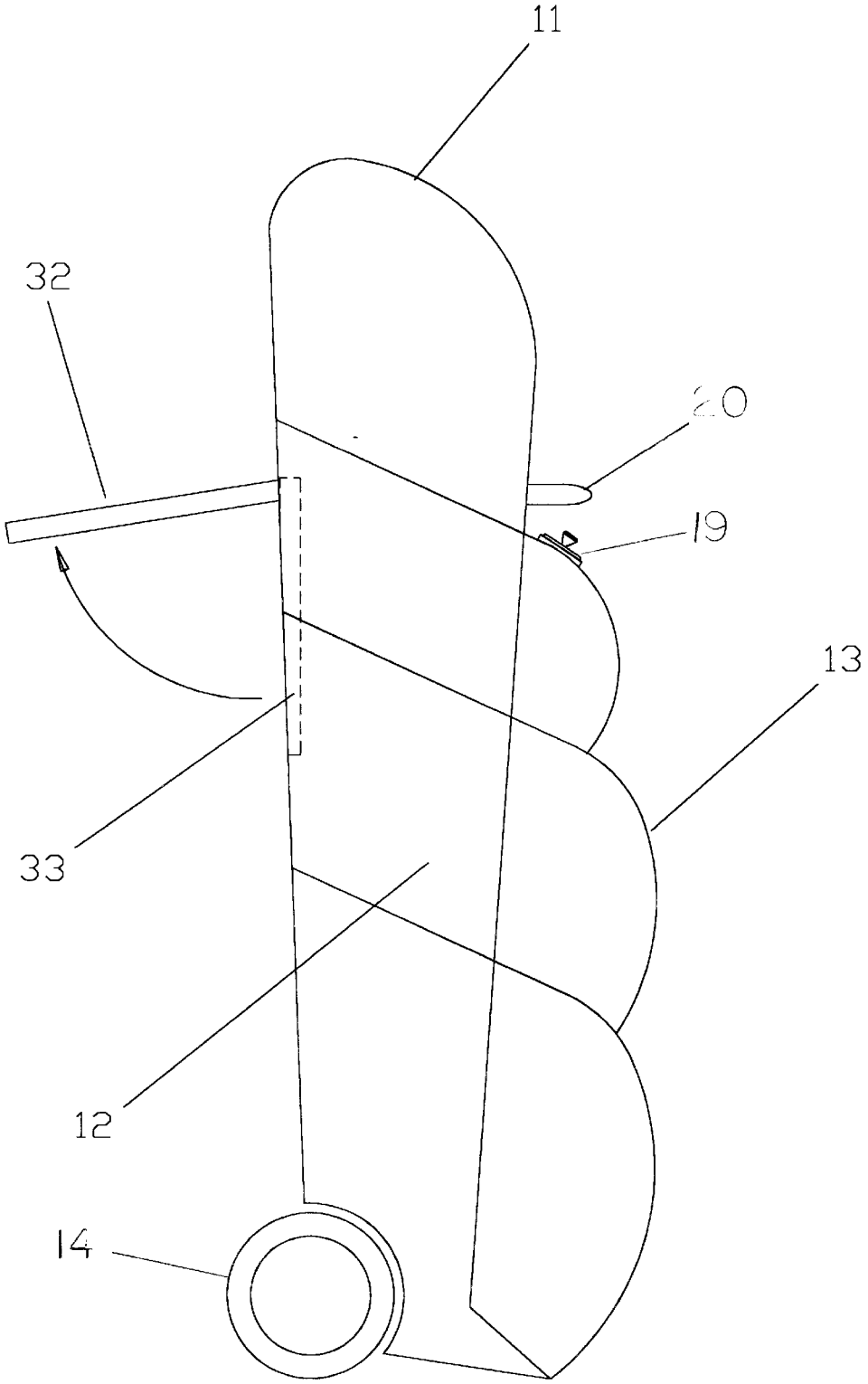
FIG. 4 is a side view of the convertible golf bag with a walking handle in an open position.
Figure 5:
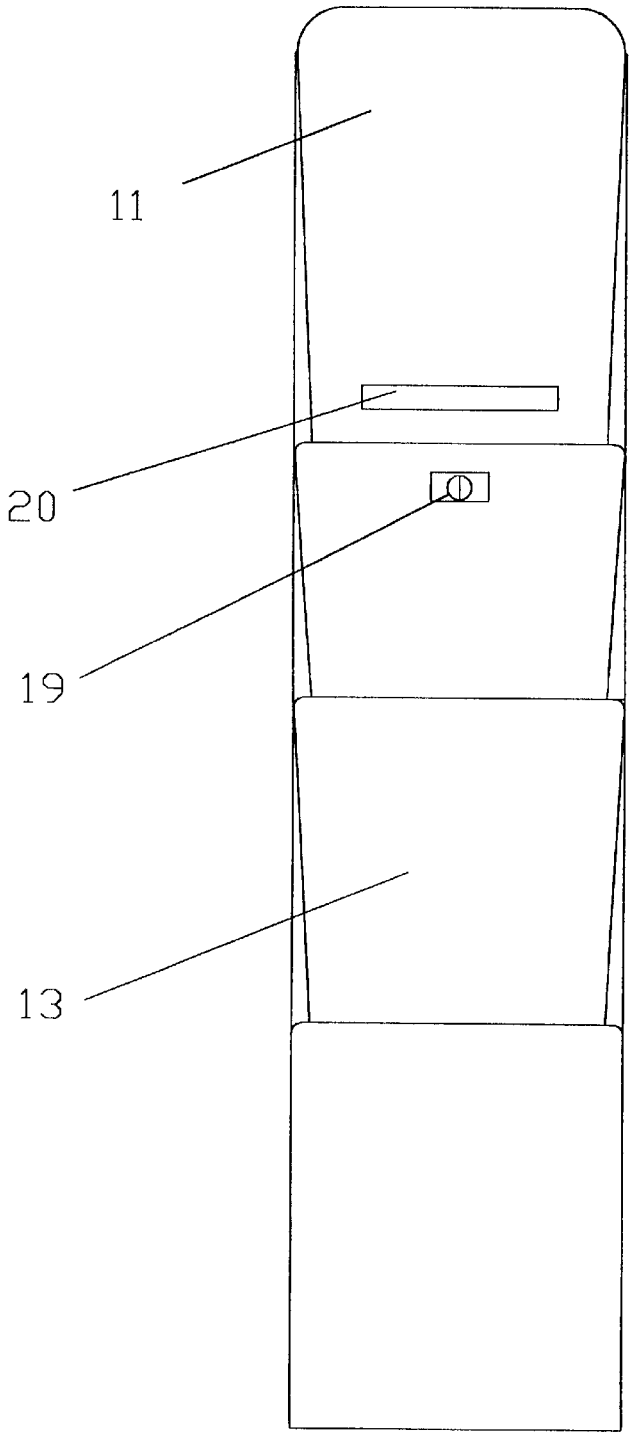
FIG. 5 is a front view of the convertible golf bag in a closed position.

As shown in FIGS. 2 and 3, hardshell front 13 is in an open position and is held in the open position by curved sliding stop 21 which is guided and held in open position by stop slot 34. Hardshell front 13 has three storage areas, pockets 28, 29, and 30. The shape of hardshell front 13, as shown in FIG. 2, was selected to provide the curved arches 35 in hardshell 13 to provide additional strength for the outer hardshell without providing any internal supports.

Other features shown in FIG. 1 are the click-lock 19 mounted on the top of hardshell front 13 to lock and unlock the two major parts, hardshell front 13, and hardshell back 12 together for packing or shipping the golf bag 10. Hinge 16 rotatably joins hardshell front 13 and hardshell back 12 for opening and closing the two parts.

A wheel recess 15 is provided to keep the outside of the wheels 14 in line and flush with the outer surface of hardshell back 12 for loading on a golf cart or for shipment of the golf bag 10. The wheels 14, however, do protrude rearwardly to provide rolling motion when pulling the golf bag 10 on a smooth surface through an air terminal without extending the wheels 14 as for pulling on a rough surface such as a golf course.

A ball tube with a ball drop hole 49 is located through and inside the left side of hardshell back 12, with a ball drop knob 48 located on the top of wood holder 18. The ball tube (not shown) runs from a hole (not shown) on the top of wood holder 18 and is designed to store up to 17 golf balls. When a player wishes to use another ball, the knob 48 is pulled upwardly, and a golf ball is ejected through drop hole 49 where it is in a playing position. Iron holder 17 is located at a lower position in hardshell back 12 than wood holder 18. The combination of wood holder 18 and iron holder 17 contain sufficient club sleeves 36 to hold a total of up to 14 golf clubs.

FIG. 1 also shows the hardshell coverhead 11 in the open and locked position for pulling the golf bag 10 while walking the golf course. The coverhead 11, when locked in position against hardshell back 12, provides an extension for handle 20 to conveniently pull the cart on a golf course. If it begins to rain, the coverhead 11 is unlocked, the score board holder 38 is dropped, and the coverhead 11 may be used to protect the clubs from getting wet.

FIG. 2 shows scoreboard holder 38 locked in a scoring position where the scorecard is readily accessible. In addition, scoreboard holder 38 also contains holders for tees 39 and a pencil 40. Holder 38 is rotatably mounted on the inside of coverhead 11 with hinge 37 which permits the holder 38 to be rotated downwardly for storage when not in use. Fastened to the open side of hardshell back 12, is a pocket 27 which may be used to hold hats of other soft materials.

Figure 6:
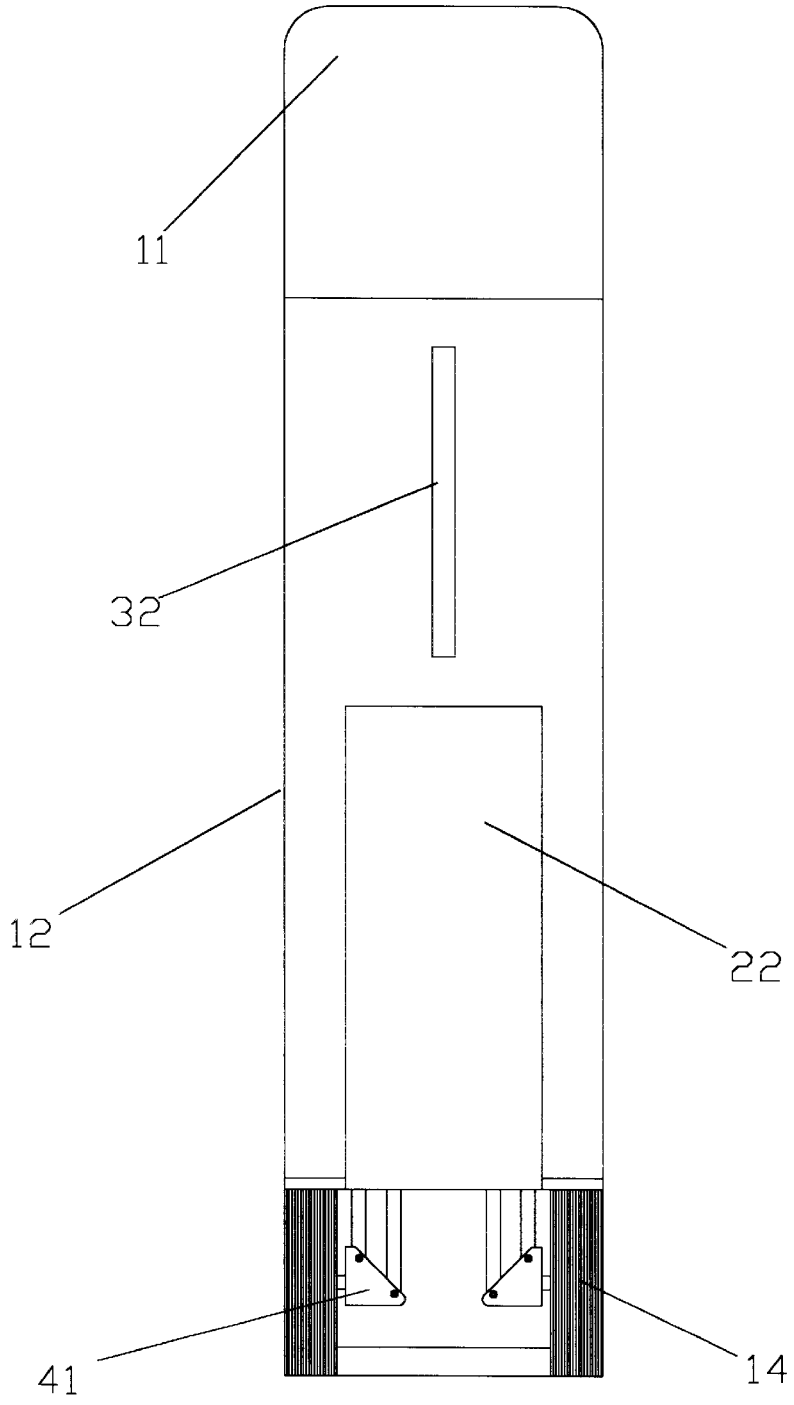
FIG. 6 is a rear view of the convertible golf bag in a closed position.

FIGS. 6 through 12 depict the operation of the retractable wheels 14 and the mechanism involved in extending and retracting the wheels 14. FIG. 6 shows the rear view of golf bag 10 with back plate 22, wheels 14, and triangular pivot plates 41. The retracting and extending elements are identical for each wheel and each comprises a pair of legs, outside legs 42 and inside legs 43, and triangular lower pivot plates 41, and upper pivot plates 41'. Legs 42 and 43 are pivoted on bearings 47 fastened to pivot plates 41 and 41'. Pivot plates 41' are fastened to a point near the top corners of back plate 22. When the legs 42 and 43 are extended, the parallelogram formed by the legs 42 and 43 and the pivot plates 41 and 41' keep the wheels 14 in a vertical position during the transition from retracted to extended.

Figure 7:
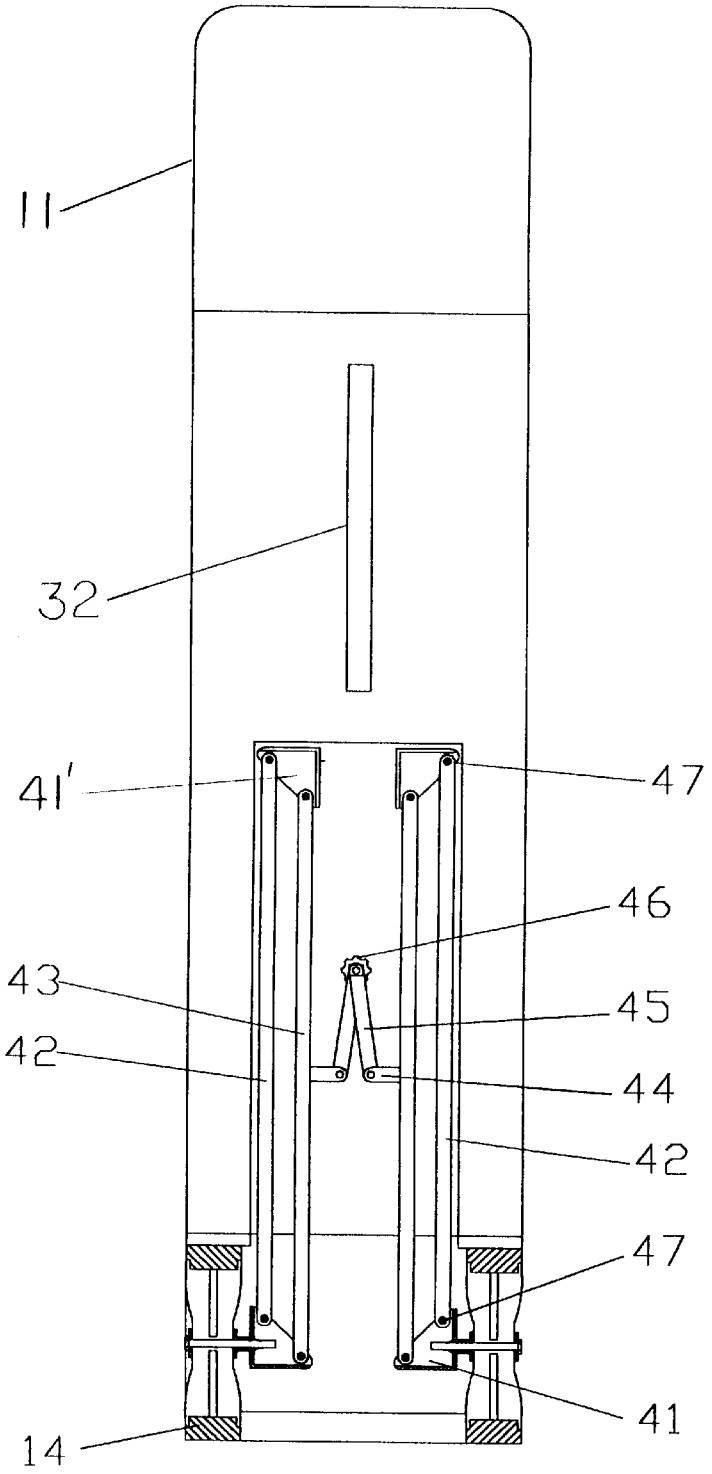
FIG. 7 is a rear view, partially in section, of the convertible golf bag in a closed position.
Figure 8:
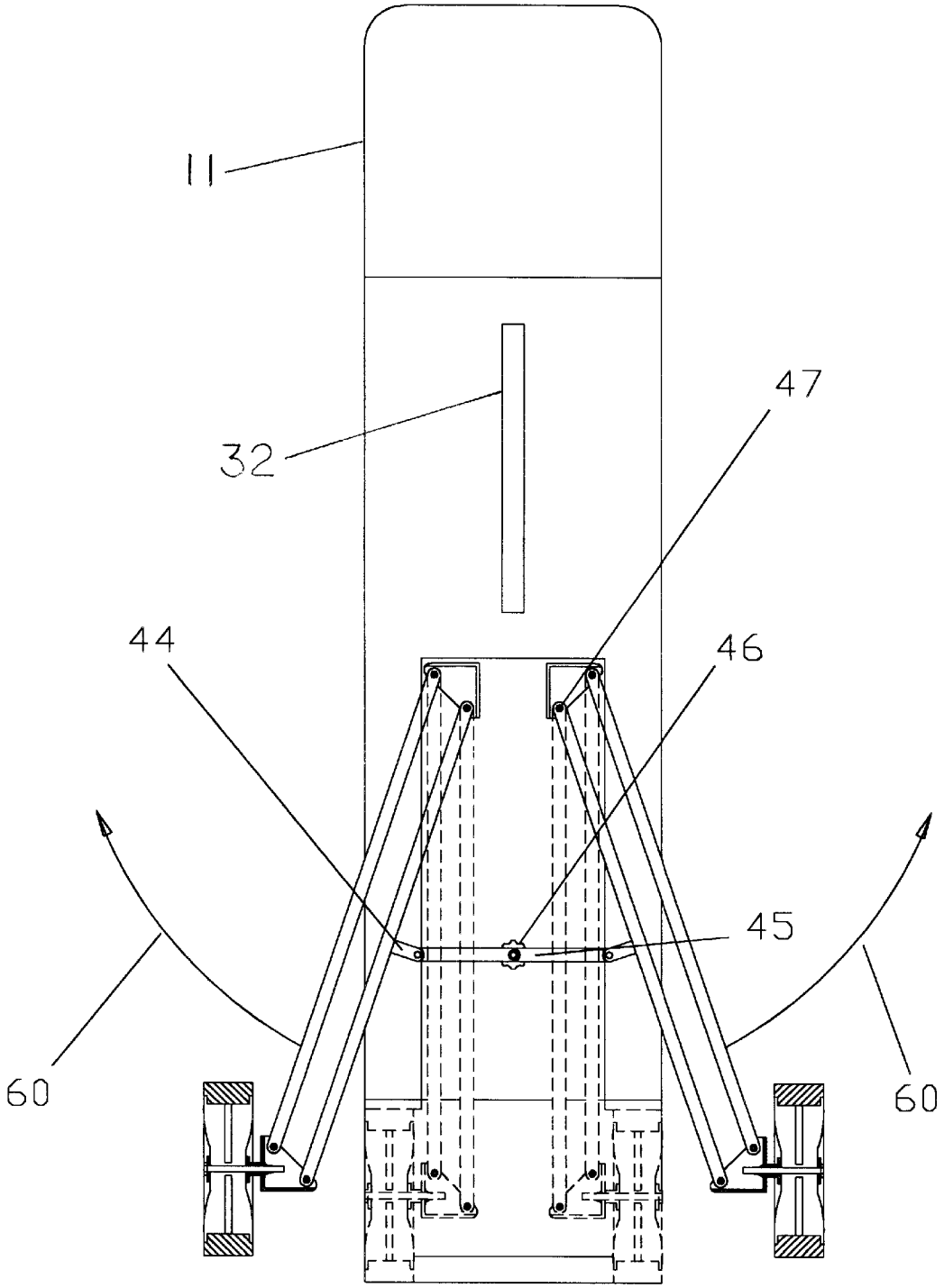
FIG. 8 is a rear view, partially in section, of the wheels of the convertible golf bag in an open position.
Figure 9:
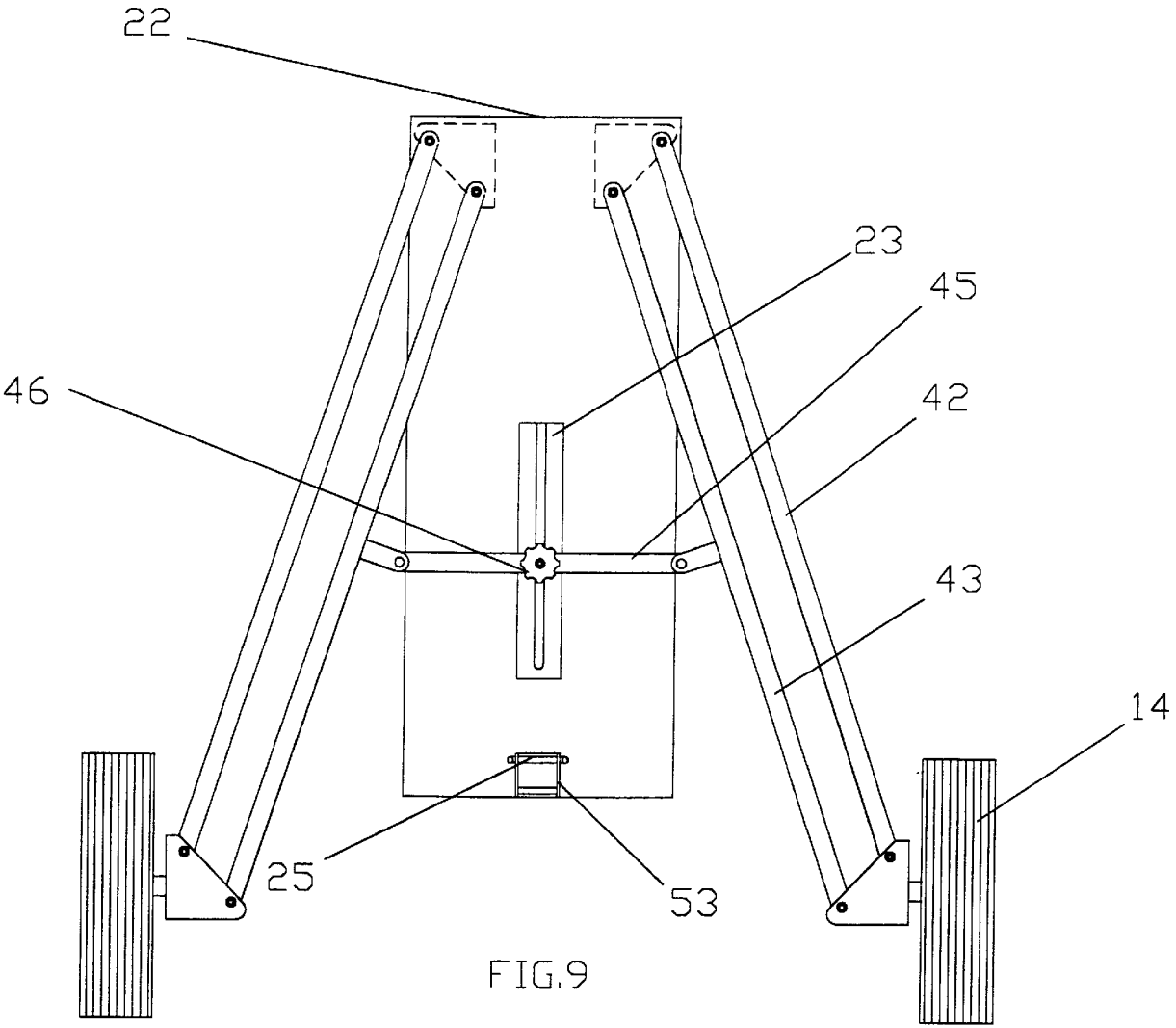
FIG. 9 is a front view, partially in section, of the wheels of the convertible golf bag in an open, extended position.
Figure 10:
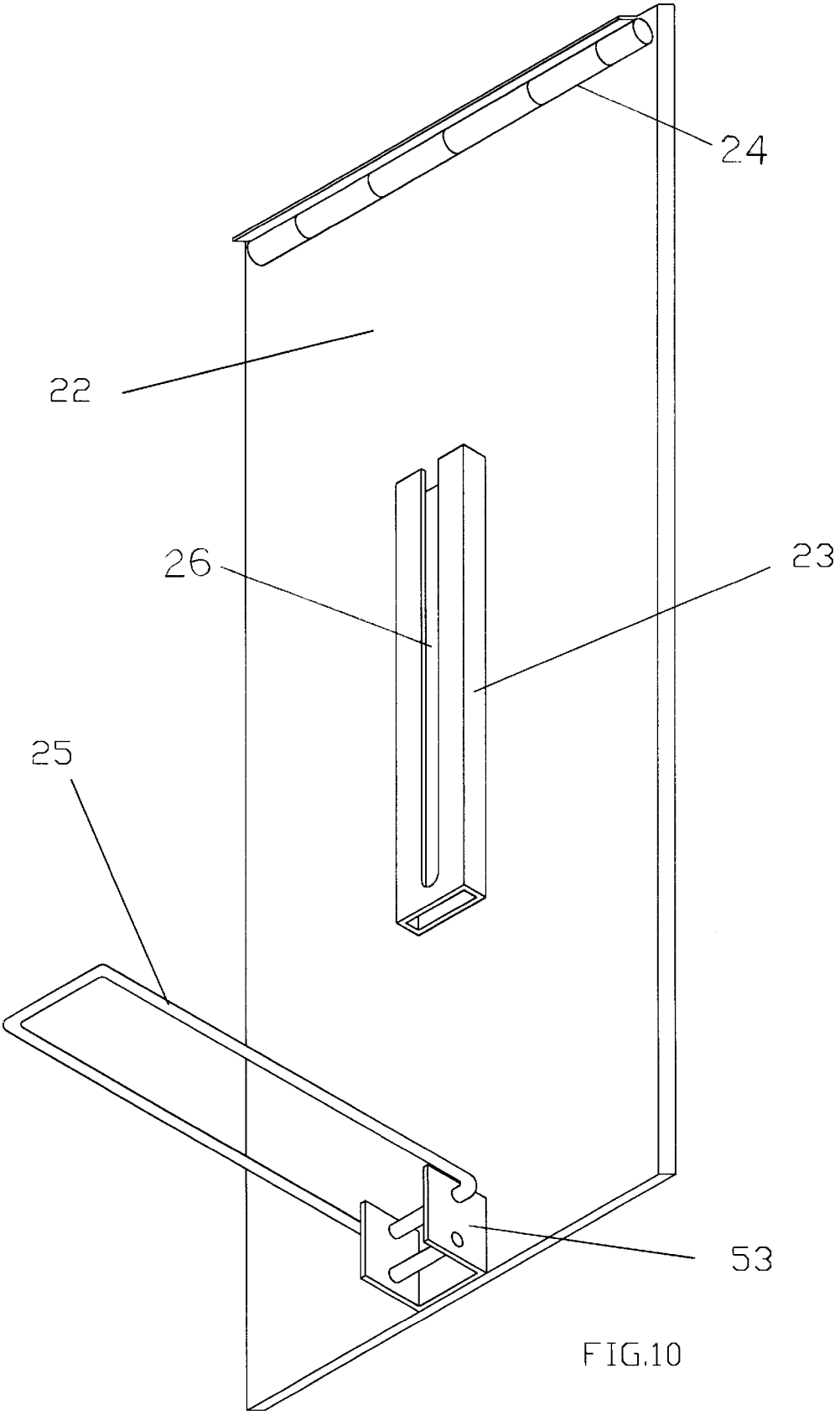
FIG. 10 is a front view of the back plate showing the locking mechanism for the retractable wheels.
Figure 12:
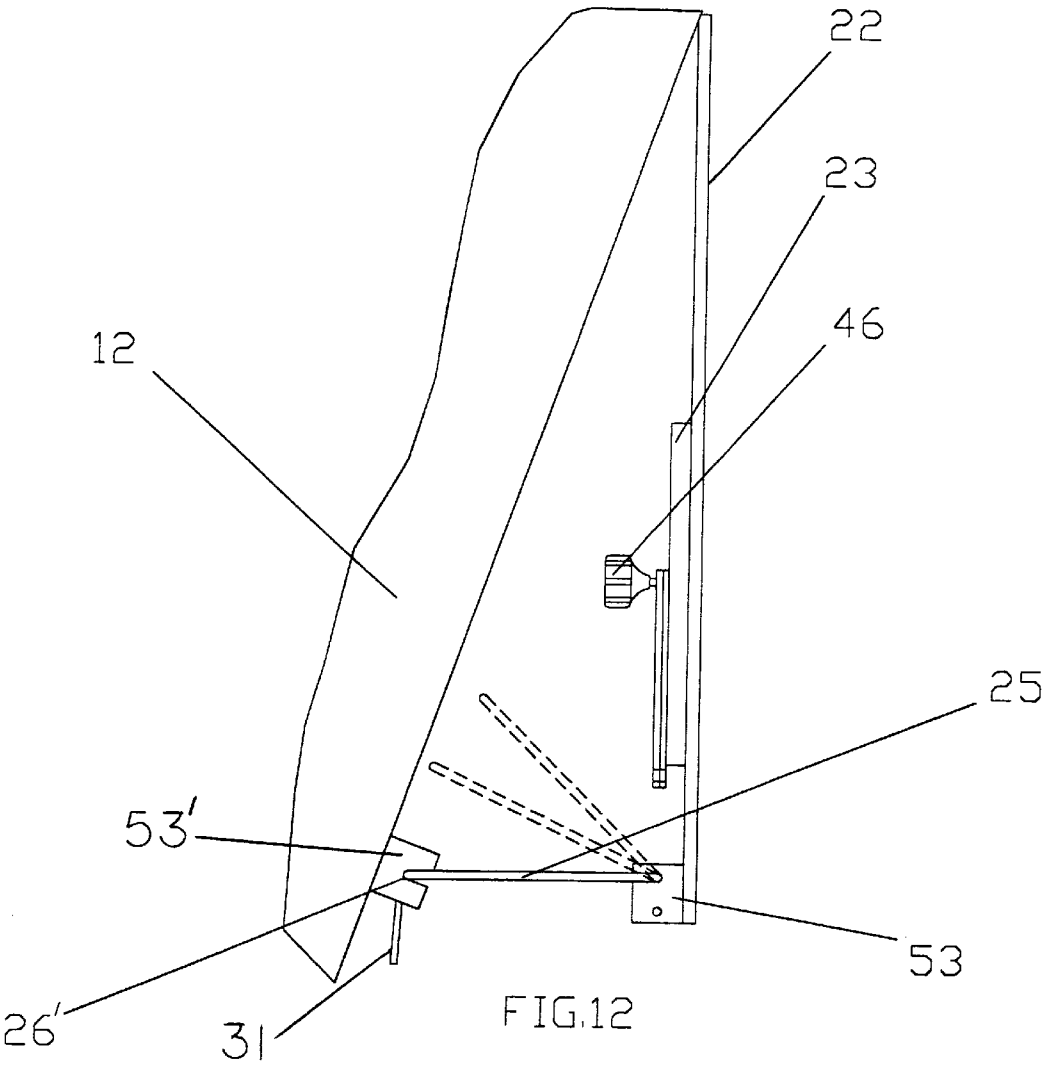
FIG. 12 is a side sectional view of the retractable wheels locking mechanism.
Figure 11:
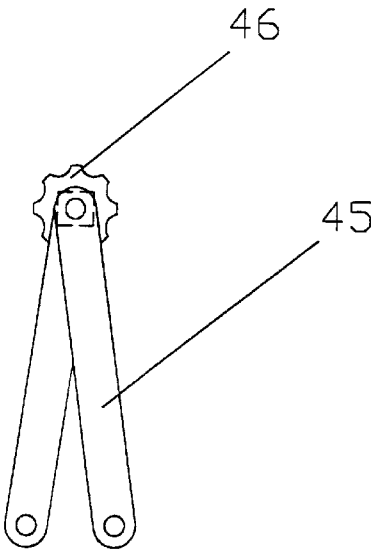
FIG. 11 is a front view of the locking screw for the retractable wheels.

The mechanism utilized to control the movement of the wheels 14 comprises a rectangular, hollow, metal, channel shaped, slide plate 23 having slot 26 formed at the center from a top end to a point near a bottom end. A locking knob 46 having a screw thread, is threaded on the shaft of a bolt having its head inserted within the slot 26 and a washer for sliding within the slot and gripping the slot when locking knob 46 is tightened. FIG. 7 shows a first end of hinge fasteners 44 affixed to the interiors of inside legs 43. A second end of hinge fasteners 44 is rotatably affixed to locking spreader hinge 45 on bearings 47. Locking spreader hinge 45 is then joined at one end by locking knob 46 at the point where locking knob 46 engages slot 26.

To spread the legs 42, 43 and thereby to extend the wheels 14, the locking knob 46 is loosened and slid down the slot 26 until it reaches the bottom of the slot 26. This sliding motion forces the pairs of legs 42, 43 outwardly and thereby extends the wheels 14. When the wheels 14 are fully extended, locking bracket 25, which is mounted on bracket 53, is inserted within slot 26' formed in bracket 53' which is affixed to back plate 22. Locking lever 31 operates a spring loaded catch to retain locking bracket 25 rigidly in place in slot 26'. Arrows 60 indicate the direction of motion of the legs 42, 43 as they are extended.

Extension of the wheels 14 begins with tilting the bag 10 forward and pulling the back plate 22 outwardly. Locking knob 46 is then loosened and slid downwardly through the slot 26 until it bottoms in the slot 26. The knob 46 is then turned to lock in place. Locking bracket 25 is then rotated downwardly and locked into position in slot 26' with locking lever 31. The golf bag 10 is then tilted back to rest on the extended wheels 14.

To add to the features available on the golf bag 10, a hanging clip 50 may be attached to the side of hardshell back 12 to provide a hanger for items such as towels or membership cards or other useful items of equipment.

Obviously, many modifications and variations of the present invention are possible in light of the above teachings. It is therefore to be understood that within the scope of the appended claims, the invention may be practiced otherwise than as specifically described.

What is claimed is:

1. A hard-shell golf bag, convertible to a golf cart and shipping case, the golf bag comprising:

a back portion, said back portion having a hard-shell exterior, a plurality of golf club sleeves, a pull rod recess, a pull rod pivotally mounted on said back portion and adapted to fit within said recess, a ball drop hole formed in said exterior and a ball drop knob slidably mounted on said back portion for selectively releasing a single golf ball through said ball drop hole, a back plate pivotally mounted on said back portion, said back plate having a first pair of wheel mounting triangular pivot plates affixed thereto, a first end of a pair of pivotable legs mounted on each of said first pivot plates, a second pair of triangular pivot plates pivotally mounted on a second end of said legs opposite said first end, a wheel rotatably mounted on each of said second pair of triangular pivot plates, first locking means fastened between said two pairs of legs for extending and retracting said two pairs of legs, second locking means removably fastened between said back plate and said back portion for locking and holding said wheels in an extended position, a front portion pivotally attached to said back portion, said front portion having a hard-shell exterior end, and an interior end having a plurality of storage pockets formed therein, sliding stop means connecting said back portion and said front portion for holding said front portion in an open position, locking means for securing said golf bag in a closed position when shipping said golf bag, and a hard-shell coverhead pivotally connected to said back portion, said coverhead having a scoreboard pivotally mounted thereto, and a pull handle formed at a first side, said coverhead being adapted to fit over said back portion and said front portion when closed, for securing the golf clubs from unauthorized entry.

2. A hard-shell golf bag of claim 1 wherein said first locking means consists of a slide plate affixed to said back plate, said slide plate having a slot formed therein, a first end of hinge fasteners affixed to the interiors of said legs, a second end of said hinge fasteners pivotally mounted on said hinge fasteners at a first end and joined together at a second end at a point where a locking knob engages said slide plate slot.

* * * * *